US005631641A

United States Patent [19]

Howe

[11] Patent Number: 5,631,641

[45] Date of Patent: May 20, 1997

[54] VEHICLE LOCATOR SYSTEM

[76] Inventor: John V. W. Howe, 325 Helen Marie La., Kingsville, Tex. 78363

[21] Appl. No.: 555,907

[22] Filed: Nov. 13, 1995

[51] Int. Cl.[6] ..... G08G 1/123

[52] U.S. Cl. ..... 340/988; 340/457; 340/309.15; 340/474

[58] Field of Search ..... 340/988, 457, 340/539, 309.15, 463, 468, 474, 430

[56] References Cited

U.S. PATENT DOCUMENTS

| | | | |
|---|---|---|---|
| 2,477,857 | 8/1949 | Boeve et al. | 340/309.15 |
| 3,967,239 | 6/1976 | Steele | 340/430 |
| 4,129,857 | 12/1978 | Espinosa | 340/321 |
| 4,305,062 | 12/1981 | Hogg et al. | 340/309.15 |
| 4,495,484 | 1/1985 | Kawakatsu et al. | 340/457 |
| 4,673,921 | 6/1987 | Saito et al. | 340/539 |
| 4,797,671 | 1/1989 | Toal, Jr. | 340/825.49 |
| 4,897,632 | 1/1990 | Lock et al. | 340/457 |
| 4,933,664 | 6/1990 | Igawa et al. | 340/425.5 |
| 5,278,556 | 1/1994 | Oh | 340/988 |
| 5,438,312 | 8/1995 | Lewis | 340/457.1 |

OTHER PUBLICATIONS

Engineer's Mini-Notebook, 555 Circuits by Forrest M. Mims, III pp. 4, 5, 8–11, 16, 17.

*Primary Examiner*—Jeffery Hofsass
*Assistant Examiner*—Benjamin C. Lee
*Attorney, Agent, or Firm*—G. Turner Moller

[57] ABSTRACT

A vehicle locator system is integrated into the electrical system of a vehicle. When a hunter leaves the vehicle, the system is activated, preferably in response to turning the ignition key to the off position. Upon the lapse of a preset first delay, the system sounds an alarm so the hunter can audibly locate the vehicle. The alarm sounds again after a delay less than the first preset delay. The delay is preferably adjustable by the user. Bird hunters typically use a delay of less than about fifteen minutes. Coon hunters typically use a delay of at least one hour and usually two. The system preferably connects to the vehicle horn relay and periodically grounds the relay to cause the vehicle horn to honk.

15 Claims, 1 Drawing Sheet

VEHICLE LOCATOR SYSTEM

This invention is an attachment for a motor vehicle used by hunters or the like so they can find their vehicles in an area where visibility is restricted.

BACKGROUND OF THE INVENTION

There are a number of situations where people become separated from a motor vehicle and desire to find it in a simple and expeditious manner. One such example are quail hunters who ride in a truck following bird dogs working on the ground in a brushy area where visibility is perhaps thirty yards. When the dogs locate quail, the hunters leave the truck and run after the dogs. In a typical hunting episode, the hunter leaves the vehicle, follows the dogs for five minutes or so and shoots a bird or two. When the hunter catches his breath and looks around, he often cannot see the vehicle. In one of those oddities of life, dogs are trained to find birds but are not trained to find trucks. Because the hunter is running after the dogs, the hunter often loses a sense of direction and cannot find the truck.

There are two known systems to help a hunter find a truck in an area of restricted visibility. Satellite based ground systems operate by using a receiver carried by the hunter. Before leaving the vehicle, the receiver is manipulated and the position of the truck is recorded. When the hunter desires to return to the vehicle, the receiver is manipulated to determine the route to the original position. These systems are expensive and require the use to manipulate the receiver before leaving the truck to establish the truck's position. In the excitement of a hunt, this is not likely to be done every time so even the most sophisticated available equipment has serious disadvantages.

Coon hunters use a radio transmitter attached to a dog's collar and a receiver carried by the hunter so the hunter can follow the dog. A similar transmitter can be placed in the truck and operates to guide the hunter back to the truck if the hunter remembers to turn it on before leaving. In the excitement of a hunt, this is not likely to be done every time so even radio tracking equipment has serious disadvantages.

Of some interest relative to this invention are U.S. Pat. Nos. 2,477,857; 4,129,857; 4,305,062; 4,797,671; 4,933,664 and 5,278,556.

SUMMARY OF THE INVENTION

In this invention, a vehicle locator system is integrated into the electrical system of the vehicle. In a preferred embodiment, the system starts when the vehicle ignition key is turned to the off position. After a preset delay, an audible alarm sounds. In the case of quail or other bird hunters, the preset delay is very short because hunting opportunities are very short. Bird hunters usually set the delay at less than fifteen minutes. Although there is some variation in preference between quail hunters, a typical delay is on the order of about seven minutes. In the case of coon hunters, the preset delay is much longer, usually at least one hour but normally less than two hours.

At the end of the preset delay, the audible alarm sounds for a few seconds and is then silent for several minutes. The duration of the alarm is sufficient to indicate the direction of the vehicle. The duration of silence between alarms allows the hunter to proceed in the correct direction, conserve electrical power and prevent the device from becoming irritating. Ideally, the first sounding causes the hunter to start in the direction of the vehicle, course corrections being made periodically when hearing subsequent soundings.

The audible alarm is preferably the vehicle horn. The vehicle locator system includes means to ground the horn relay which causes the horn to honk.

It is an object of this invention to provide an audible vehicle locator system.

Another object of this invention is to provide an audible vehicle locator system particularly suited for hunters.

A further object of this invention is to provide an audible vehicle locator system which, after a preset delay, periodically sounds an alarm so a user can find a visually obscured vehicle.

Other objects and advantages of this description will become more apparent as this description proceeds, reference being made to the accompanying drawings and appended claims.

DETAILED DESCRIPTION

Figure 1:
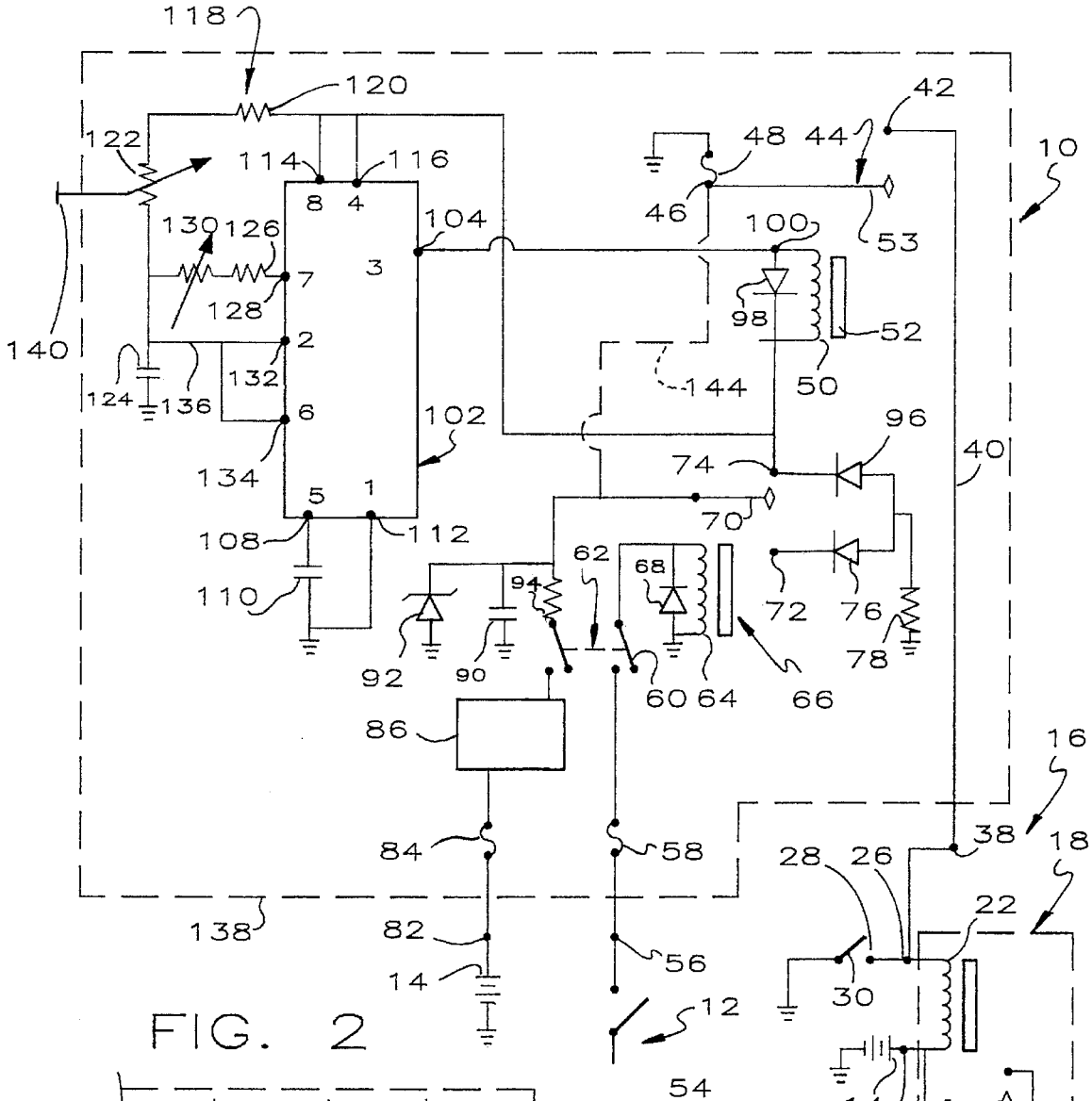
FIG. 1 is a schematic circuit diagram of a vehicle locator system of this invention.

Referring to FIG. 1, a vehicle locator system 10 of this invention is integrated into the electrical system of a motor vehicle of any suitable type having an engine equipped with one or more electrical circuits necessary for operation of the engine such as an ignition circuit 12, a source of electric power such as a battery 14 and a horn assembly 16 including a horn relay 18 and a horn 20. The horn relay 18 includes a solenoid winding 22 having one terminal 24 connected to the vehicle power supply 14, a second terminal 26 connected to wiring 28 leading to the horn switch 30 mounted on the steering wheel (not shown) of the vehicle.

Sounding of the horn 20 normally occurs because the horn switch 30 is closed by the driver to complete the circuit through the solenoid winding 22. This causes current to flow in the winding 22 to move the solenoid plunger 32 to close the contacts 34 and thereby close a power circuit 36 through the horn 20. As will become more fully apparent hereinafter, the vehicle locator system 10 of this invention operates by periodically grounding the solenoid terminal 26 in a sequence controlled by the circuitry of the vehicle locator system 10.

To this end, the vehicle locator system 10 includes a terminal 38 for connection to the terminal 26 of the horn relay 18. The terminal 38 is connected by a wire 40 to a normally open contact 42 of a relay 44 having an output 46 grounded through a fuse 48. It will be seen that energizing the relay solenoid winding 50 moves the solenoid plunger 52 and thereby moves the switch arm 53 into engagement with the contact 42 thereby grounding the contact 42 and sounding the horn 20. It will accordingly be seen that the remainder of the vehicle locator system 10 involves energizing the solenoid winding 50 at appropriate times.

One feature of this invention is that operation of the system 10 starts by shutting off the engine and thereby opening some electrical circuit necessary for operation of the engine. This is represented by the ignition circuit 12 which is opened by the conventional ignition key switch 54. The vehicle locator system 10 accordingly includes a terminal 56 connected to the ignition key switch 54. A fuse 58 and one leg 60 of a double pole on-off switch 62 connects the terminal 56 to a solenoid winding 64 of a relay 66. A diode 68 protects the winding 64 against voltage/current spikes caused by closing of the relay 66. A solenoid plunger 68 accordingly moves a switch arm 70 moving the switch contact away from a normal position engaging a contact 72 into engagement with a normally open contact 74.

With the on-off switch 62 closed and the ignition key switch 54 in the engine operating position, current flows through the solenoid winding 64 to close the switch arm 70 against the contact 72. The only effect on the vehicle locator system 10 of the engine running is accordingly the illumination of a light emitting diode 76, which preferably shows green, which is grounded through a resistance 78. When the ignition key switch 54 is turned to the engine off position, current to the solenoid winding 64 stops thereby moving the switch arm 70 into engagement with the contact 74. The relay contact 74 is connected to the solenoid winding 50 of the relay 44 which allows control of the relay 44 to come under control of a timer mechanism 80.

The timer mechanism 80 includes a terminal 82 connected by a fuse 84 to an optional clock 86. As will be more fully apparent hereinafter, the time delay afforded by the timer mechanism 80 is the result of some resistor-capacitor networks. If it is desirable to have longer time delays that can be provided by simple resistor-capacitor networks, the optional clock 86 is desirable. For example, quail hunters may desire a ten minute delay from the time the ignition key switch 54 is opened until the horn 20 starts honking. Delays of this magnitude are easily within the capability of resistor-capacitor networks. Longer delays desired by coon hunters, on the order of an hour or two, are beyond the capacity of resistor-capacitor networks and require the optional clock 86. In function, the clock 86 including a normally open switch that closes after the lapse of a predetermined time.

The output of the clock 86 connects to a second leg 88 of the on-off switch 62. A capacitor 90 acts to filter voltage spikes out from the vehicle power supply 14 and a zenier diode 92 acts in conjunction with a resistor 94 to regulate voltage in the system 10. Thus, with the on-off switch 62 closed and the ignition key switch 54 open, the vehicle power supply 14 is connected to the contact 74. The immediate consequence is that a light emitting diode 96 is energized signalling that the vehicle locator system 10 is operating. The diode 96 preferably shows red. Preferably the light emitting diodes 76, 96 are a single bicolor light emitting diode as will be evident to those skilled in the art.

It will accordingly be seen that power is supplied to the relay winding 50 and a diode 98 which protects the circuit from voltage/current spikes created by switching of the relay 44. All that is needed to energize the relay 42 is to ground the opposite terminal 100. It will be seen that the horn 20 honks every time the terminal 100 of the relay 42 is grounded and continues to honk so long as the terminal 100 is grounded. Although the terminal 100 may be grounded in the desired sequence in any suitable manner, a simple, inexpensive and expeditious technique for doing so involves using a conventional integrated circuit timer chip such as is available from Texas Instruments as Model NE 555 P. Description of this chip and its operation is found in a manual entitled Engineer's Mini-Notebook, 555 Circuits by Forrest M. Mims, III, copyrighted 1984 and available from Radio Shack, to which reference is made for a more complete description.

The timer mechanism 80 includes a conventional integrated circuit timer chip 102 having a pin 104 connected by a lead 101 to the terminal 100 and an input lead or wire 106 connected to the contact 74. A control voltage pin 108 of the chip 102 is grounded through a capacitor 110 is grounded to stabilize the voltage on the chip 102. A pin 112 is grounded.

The input power wire 106 connects to pins 114, 116 and to a resistor-capacitor network 118 including a fixed resistor 120 setting the minimum time between horn activations and a variable resistor 122. The variable resistor 122 adjusts the time between horn activations from a minimum time, set by the resistor 120, to a maximum time which is a function of the additive values of the resistors 120, 122. A capacitor 124 grounds the resistors 120, 122 and creates the timing cycles by charging and discharging in a conventional manner.

A fixed resistor 126 connects to a pin 128 on the timer chip 102 and establishes the minimum time the horn remains on. A variable resistor 130 adjusts this time on from a minimum value set by the resistor 126 to a maximum value which is a function of the additive values of the resistors 126, 130. The capacity 124 also grounds the resistors 126, 130. Pins 132, 134 on the chip 102 are connected by a lead 136 to ground through the capacitor 124.

Typical values for the components of the system 10 are:

| | |
|---|---|
| resistor 78 - 680 ohms | capacitor 124 - 470 μf, 16 v |
| resistor 126 - 220 k ohms | capacitor 110 - .01 μf, 16 v |
| resistor 120 - 3.6 k ohms | capacitor 90 - 470 μf, 16 v |
| resistor 122 - 0–2.0 meg ohms | fuse 58 - 1 amp |
| resistor 130 - 0–20 meg ohms | fuse 84 - 8 amp |
| resistor 94 - 47 ohms | fuse 48 - 1 amp |
| relay 66 - 12 v | relay 42 - 9 v |
| zenier diode 92 - 9.1 v, 1 w | |

The numbers appearing inside the timer circuit block are the pin numbers used by Mims in Engineer's Mini-Notebook.

Operation of the vehicle locator system 10 of this invention should now be apparent. With the on-off switch 60 closed and the ignition key switch 54 open or in the off position, the diode 96 shows red. When the ignition key switch 54 closed or in the engine running position, the diode 76 shows green and the leads 101, 106 are dead, i.e. no voltage from the vehicle source 14 is present. When a user turns the key switch 54 off, the relay 66 closes against the contact 74 so the diode 96 shows red and voltage is present on the leads 101, 106 which activates the integrated circuit timer chip 102.

When power is applied through the wire 106 to the pins 114, 116 and to the resistor 120, the timing circuit beings to operate. The capacitor 124 begins to be charged by current flowing through the resistors 120, 122. The voltage on the capacitor 124 is an input to the timer chip 102 through the pins 132, 134. The pin 132 senses for the situation where the voltage on the capacitor 124 is one-third of the supply voltage on pin 114 and pin 134 senses for the situation where the voltage on the capacitor 124 is two-thirds of the supply voltage.

When the voltage on the capacitor 124 reaches a value of two-thirds of the voltage on the pin 114, the timer chip 102 grounds the pin 104 through the pin 112 causing current to flow in the solenoid coil 50 thus closing the relay arm 53 against the contact 42 and grounding the horn relay solenoid 22. At the same time pin 104 is grounded, the pin 128 is grounded through the pin 112 thus discharging the capacitor 124 through the resistors 126, 130. When the voltage on the capacitor 124 falls from two-thirds of the supply voltage to one third of the supply voltage, the timer chip 102 shuts off and the pins 104, 128 are no longer grounded. Thus, the capacitor 124 beings to charge and the relay 44 is opened thus stopping sounding of the horn 20. Accordingly, the rate at which the capacitor 124 discharges through the resistors 126, 130 controls the duration of the horn honking and is, of course, a function of the additive resistance values of the resistors 126, 130.

It will be noted that the horn 20 is sounded the second time when the capacitor 124 recharges to a value so the timer chip 102 senses it has reached two-thirds of supply voltage. Thus, the delay between the first and second horn soundings is less than the delay between closing the ignition key switch 54 and the first sounding because the capacitor 124 only has to recharge from one-third supply voltage to two-thirds supply voltage.

For bird hunters, it is very desirable that the delay between closing of the ignition key switch 54 and first sounding of the horn 20 be very short, e.g. less than fifteen minutes. Optimum times depend on the preferences of the hunter, the terrain and the hunting opportunities so it may be desirable to allow adjustment of the resistance 122 from the exterior of a housing 138 as by the provision of a control knob 140. Optimum times are typically less than ten minutes, e.g. seven minutes.

Figure 2:
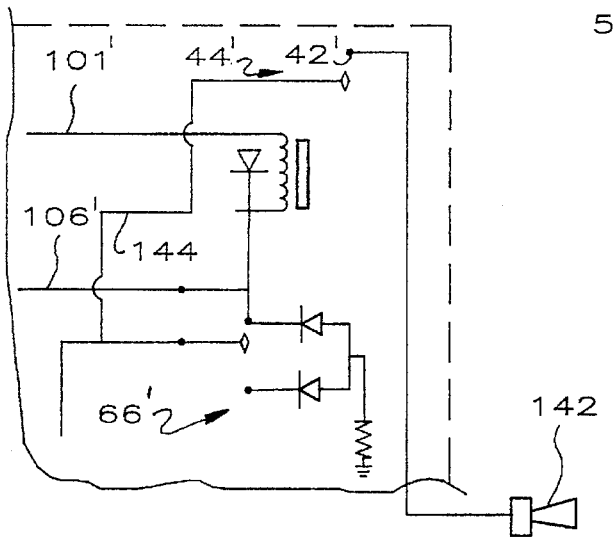
FIG. 2 is a partial schematic circuit diagram of another embodiment of a vehicle locator system of this invention.

Referring to FIG. 2 where primed reference characters are used to designate components identical to the embodiment of FIG. 1, another embodiment of a vehicle locator system 140 is identical to the system 10 except that the system 140 actuates an audible alarm 142 by applying the full voltage of the vehicle power system. Basically, the fuse 48 and its ground connection have been eliminated and a lead 144 provided between the input of the relay 66' and the input of the relay 44'. When the timer mechanism grounds the lead 101' from the timer mechanism to the relay 44', the switch arm 53' moves to engage the contact 42' and deliver the full voltage of the vehicle power system to the alarm 142. The vehicle locator system 140 otherwise operates in the same manner as the system 10.

The same effect can be created in the locator system of FIG. 1 by removing the fuse 48 from its holder (not shown) or deleting it from the circuit board and attaching a highly conductive shunt 146, such as a copper wire of some capacity, as shown in phantom lines in FIG. 1.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A vehicle locator system for indicating the location of a motor vehicle having an engine, a first electrical circuit necessary for continued operation of the engine in its closed circuit state, an electrical power source and an audible alarm, comprising first means for connection to the electrical power source for energizing the system;

second means for connection to the audible alarm;

third means for connection to the first electrical circuit;

means for sounding the audible alarm including a second circuit having a normal condition not sounding the alarm and an active condition for sounding the audible alarm;

a delay mechanism allowing selection of a period of time at an end of which the second circuit is activated for sounding the audible alarm; and means for initiating operation of the delay mechanism in response to opening the first electrical circuit.

2. The vehicle locator system of claim 1 further comprising an on-off switch for disabling the alarm system.

3. The vehicle locator system of claim 1 wherein the period of time is less than fifteen minutes.

4. The vehicle locator system of claim 1 further comprising means operative after activation of the second circuit for temporarily deenergizing the audible alarm and then reenergizing the audible alarm, the interval during which the audible alarm is deenergized is less than the period of time between opening of the first electrical circuit and activation of the audible alarm.

5. The vehicle locator system of claim 1 wherein the first circuit includes a key switch for opening and closing the first circuit.

6. The vehicle locator system of claim 1 wherein the delay mechanism includes a resistor-capacitor network.

7. The vehicle locator system of claim 6 wherein the delay mechanism includes a timer.

8. The vehicle locator system of claim 1 wherein the audible alarm includes a horn, a normally open horn circuit for energizing the horn and a horn relay operative upon grounding for closing the horn circuit, the second circuit comprising means for grounding the horn relay.

9. The vehicle locator system of claim 8 further comprising means operative after activation of the second circuit for temporarily deenergizing the horn and then reenergizing the horn.

10. The vehicle locator system of claim 9 wherein the last mentioned means comprises means for ungrounding the horn relay and then regrounding the horn relay.

11. A vehicle locator system for indicating the location of a motor vehicle having a first electrical circuit necessary for continued normal operation of the motor vehicle in its closed circuit state, an electrical power source and an audible alarm, comprising:

first means for connection to the electrical power source for energizing the system;

second means for connection to the audible alarm;

means for sounding the audible alarm including:

a second circuit having a normal condition not sounding the alarm and an active condition for sounding the audible alarm;

a delay mechanism allowing selection of a period of time less than about fifteen minutes at an end of which the second circuit is activated for sounding the audible alarm: and means for initiating operation of the delay mechanism in response to opening the first electrical circuit.

12. The vehicle locator system of claim 11 further comprising means operative after activation of the second circuit for temporarily deenergizing the audible alarm.

13. The vehicle locator system of claim 12 wherein the interval during which the audible alarm is deenergized is less than the period of time.

14. A vehicle locator system for indicating the location of a motor vehicle having an engine, a first electrical circuit necessary for continued operation of the engine in its closed circuit state, an electrical power source, an audible alarm having a horn, a normally open horn circuit for energizing the horn and a horn relay operative upon grounding for closing the horn circuit, compromising:

first means for connection to the electrical power source for energizing the system;

second means for connection to the audible alarm;

means for sounding the horn including:

a second circuit having a normal condition not sounding the alarm and an active condition for sounding the audible alarm;

a delay mechanism allowing selection of a period of time at an end of which the second circuit is activated for sounding the audible alarm;

means for grounding the horn relay at the end of the period of time; and means for initiating operation of the delay mechanism in response to opening the first electrical circuit.

15. The vehicle locator system of claim 14 wherein the horn sounding means comprises means for ungrounding the horn relay and then regrounding the horn relay.

* * * * *